US011457519B2

(12) United States Patent
Leermakers

(10) Patent No.: US 11,457,519 B2
(45) Date of Patent: Sep. 27, 2022

(54) LIGHTING FIXTURE FOR A LIGHT EMITTING DIODE, LED, LIGHTING DEVICE

(71) Applicant: SIGNIFY HOLDING B.V., Eindhoven (NL)

(72) Inventor: Remco Christianus Wilhelmus Leermakers, Tilburg (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/297,024

(22) PCT Filed: Nov. 18, 2019

(86) PCT No.: PCT/EP2019/081646
§ 371 (c)(1),
(2) Date: May 26, 2021

(87) PCT Pub. No.: WO2020/109055
PCT Pub. Date: Jun. 4, 2020

(65) Prior Publication Data

US 2022/0030689 A1 Jan. 27, 2022

(30) Foreign Application Priority Data

Nov. 30, 2018 (EP) ..... 18209498

(51) Int. Cl.
*H05B 45/52* (2020.01)
*H01H 23/14* (2006.01)

(52) U.S. Cl.
CPC ..... *H05B 45/52* (2020.01); *H01H 23/143* (2013.01)

(58) Field of Classification Search
None
See application file for complete search history.

(56) References Cited

U.S. PATENT DOCUMENTS

2012/0155074 A1 6/2012 Mori et al.
2013/0076245 A1 3/2013 Phadke
(Continued)

FOREIGN PATENT DOCUMENTS

EP 0395514 A1 10/1990
EP 2596554 A1 5/2013
(Continued)

*Primary Examiner* — Dedei K Hammond
(74) *Attorney, Agent, or Firm* — Daniel J. Piotrowski

(57) ABSTRACT

A lighting fixture for a Light Emitting Diode, LED, lighting device, said fixture comprising an LED driver arranged to receive an Alternating Current, AC, mains voltage as input and provide an LED current to drive said LED lighting device; at least one socket comprising receiving means, arranged to receive and hold an LED lamp arranged to emit light, said socket further comprising a biased Double Pole Double Throw, DPDT, switch, comprising one set of input terminals and two sets of output terminals, wherein the output of said LED driver is connected to said input terminals of said biased DPDT switch, wherein a first of said two output terminals of said biased DPDT switch are short circuited, and wherein said biased DPDT switch is arranged to toggle between a short circuit position wherein said input terminals of said biased DPDT switch are connected to said first set of output terminals, and a connected position wherein said input terminals of said biased DPDT switch are connected to a second of said two output terminals, thereby connecting said LED driver to said LED lighting device; wherein said biased DPDT switch is further arranged to toggle from said short circuit position to said connected position upon insertion of said LED lighting device into said receiving means of said socket. A corresponding method of toggling a switch is also presented herein.

11 Claims, 4 Drawing Sheets

(56) References Cited

U.S. PATENT DOCUMENTS

| | | | | |
|---|---|---|---|---|
| 2013/0307416 | A1* | 11/2013 | Xu | H05B 47/10 315/122 |
| 2014/0091714 | A1 | 4/2014 | Sutardja et al. | |
| 2018/0249540 | A1 | 8/2018 | Chawda et al. | |

FOREIGN PATENT DOCUMENTS

| | | | |
|---|---|---|---|
| JP | 2009044055 | A | 2/2009 |
| JP | 2009-510667 | A | 3/2009 |
| JP | 2009-541937 | A | 11/2009 |
| JP | 2012048964 | A | 3/2012 |
| WO | 2012150190 | A1 | 11/2012 |

* cited by examiner

LIGHTING FIXTURE FOR A LIGHT EMITTING DIODE, LED, LIGHTING DEVICE

CROSS-REFERENCE TO PRIOR APPLICATIONS

This application is the U.S. National Phase application under 35 U.S.C. § 371 of International Application No. PCT/EP2019/081646, filed on Nov. 18, 2019, which claims the benefit of European Patent Application No. 18209498.7, filed on Nov. 30, 2018, These applications are hereby incorporated by reference herein.

TECHNICAL FIELD

The present disclosure generally relates to the field of lighting and, more specifically to a Light Emitting Diode, LED, lighting fixture, comprising a replaceable light emitting module. The present disclosure further relates to a method of operating the lighting fixture.

BACKGROUND

It is expected that, in the future, Light Emitting Diode, LED, modules will become exchangeable in the field. This is driven by legislation and by the need to replace incidentally failed modules in the field.

During replacement of such modules, it may be expected that the driver that is powering the system is not switched off. Replacing the LED module while the driver is still powered is called hot-plugging and requires certain attention which are hereby described.

When the exchangeable LED module is exchanged while the driver is still powered, the driver goes to tits open voltage when no LED module is connected. When plugging-in the LED module, the output stage of the driver, which often comprises capacitors, will be discharged from the open voltage to the LED string voltage. This generates a peak current which flows from the driver to the LEDs. This is called the outrush current.

To reduce the outrush current, an electronic current can be placed on each LED module. This circuit may absorbs the outrush current of the driver. But such an additional circuit has the disadvantage that it adds cost to the LED module, uses Printed Circuit Board, PCB, space and is visible on the LED module. The outrush current reduction circuit can be placed elsewhere, for example on additional slide contacts. In such a configuration, the outrush reduction circuit is disabled when the module is plugged in. But additional circuits increase the cost of the module.

When a single lighting fixture comprises multiple LED modules that need to be replaced, the driver does not know that only one module, or fewer than intended modules, are plugged in. This results in the driver powering the connected modules with too much current. Such a high current value can cause damage to the LED modules and must be prevented.

SUMMARY

In a first aspect of the present disclosure, there is provided a lighting fixture for a Light Emitting Diode, LED, lighting device. The fixture comprises an LED driver arranged to receive an Alternating Current, AC, mains voltage as input and provide an LED current to drive said LED lighting device, and at least one socket comprising receiving means, arranged to receive and hold an LED lamp arranged to emit light. The socket further comprises a biased Double Pole Double Throw, DPDT, switch, comprising one set of input terminals and two sets of output terminals, wherein the output of said LED driver is connected to said input terminals of said biased DPDT switch, wherein a first of said two output terminals of said biased DPDT switch are short circuited.

The biased DPDT switch is arranged to toggle between a short circuit position wherein said input terminals of said biased DPDT switch are connected to said first set of output terminals, and a connected position wherein said input terminals of said biased DPDT switch are connected to a second of said two output terminals, thereby connecting said LED driver to said LED lighting device. The biased DPDT switch is further arranged to toggle from said short circuit position to said connected position upon insertion of said LED lighting device into said receiving means of said socket.

It is expected that LED modules will be replaceable in the future and that the LED driver may not be powered off completely while performing the action of replacement of the LED modules. A typical LED lighting fixture comprises an LED driver. The LED driver receives input energy from an AC mains power supply and provides a suitable current to drive the LED modules. Multiple configurations for the LED driver are known to the skilled person.

The lighting fixture usually comprises one or more sockets into which a lighting module may be inserted. In order to hold the inserted LED lighting module in place, the socket may comprise a receiving means such as a lock, a latch or a screwing in mechanism. The inventors consider that it may be advantageous to include a biased DPDT switch in the socket.

The number of poles on a switch defines how many separate circuits the switch can control. So a switch with one pole, can only influence one single circuit. A two-pole switch can separately control two different circuits. A switch's throw-count defines how many positions each of the switch's poles can be connected to. For example, if a switch has two throws, each circuit (pole) in the switch can be connected to one of two terminals.

The skilled person understands that functioning of the DPDT switch may be implemented by employing a physical switch, or the same functionality may be achieved by means of other suitable hardware or software. The DPDT switch comprises one set of input terminals and two sets of output terminals. The input terminals are connected to the output of the LED driver. One set of output terminals are internally shorted and one set of output terminals are arranged to be connected to the LED lighting module when such a module is inserted.

Furthermore, the DPDT switch is biased in that it is arranged to remain in one particular position. Preferably, the switch is in the short circuit position such that the input terminals are connected to the set of terminals that are internally short circuited. The insertion of a LED lighting module into the socket causes the switch to toggle to the connected position wherein the input terminals are connected to the second set of output terminals and thereby to the LED module. The switch shall remain in this connected position, wherein the input terminals are connected to the second set of output terminals, until the LED lighting module remains inserted in the receiving means of the socket.

The lighting fixture often comprises more than one socket that are arranged to receive one LED lighting module for each socket. Such a configuration is often necessary to provide a required amount of light output. In such a scenarios, there is only one LED driver that collectively supplies the required current to all the modules. An advantage of the present disclosure is that the LED driver will continue to see a short circuit at its output terminals as long as LED lighting module is inserted into each socket of the lighting fixture.

The LED driver usually has a preventive mechanism to prevent short circuit currents and therefore will not supply any current to the connected LED modules unless all the required LED lighting modules will be connected. Therefore the lighting device according to the present disclosure ensures that the connected lighting modules are not subjected to a larger outrush current thereby causing damage to the lighting module.

According to an example, the LED driver is arranged to operate in a low power mode upon detecting a short circuit. Some LED drivers known to the skilled person have a so called hiccup mode. In such LED drivers, upon detecting a short circuit at the output terminals of the LED driver, the LED driver ensures that the output LED current is set to zero. Incorporating such a driver in the lighting fixture of the present disclosure ensures that the LED driver will not start supplying any current to the lighting modules until all the LED modules have been connected. Therefore, each LED lighting module shall receive the rated amount of current and not any more. This may be helpful in ensuring that the lighting modules are not subjected to a high amount of current thereby reducing the chances of damage to the LED lighting module.

In an embodiment, the biased DPDT switch is further arranged to toggle from said connected position to said short circuit position when said LED lighting device is removed from said receiving means of said socket. The bias in the DPDT switch causes the switch to return to the short circuit position when an LED lighting module is removed from a respective socket. This ensures that as soon as a lighting module is removed from the socket, the LED driver sees a short circuit at its output terminals.

According to an example, the biased DPDT switch is spring loaded. The person skilled in the art is aware of means of biasing a switch. The spring maybe connected in such a manner to ensure that the switch remains in the short circuit position until the LED lighting module is inserted into the receiving means of the socket.

In an embodiment the receiving means is arranged to receive a dummy element, said dummy element being arranged to emulate an LED lighting device without emitting light. It may be beneficial to consider that if a lesser light output is required from the lighting fixture, the socket may be arranged to receive a dummy element that emulates an LED lamp without emitting any light. Such a dummy element may or may not draw an equivalent amount of current. The skilled person understands that if the dummy element draws a current, it may need to be dissipated in some form, as heat, for example.

According to an example, the lighting fixture comprises at least two sockets arranged to receive one LED lamp per socket, such that said lever switch connector of at least one socket is in said short circuit position until each socket receives either said LED lighting device or said dummy element.

In an embodiment, the at least two sockets are connected in a parallel configuration such that said LED current from said LED driver is distributed between said at least two sockets.

In a second aspect of the present disclosure, there is presented a method of toggling a switch in a lighting fixture for a Light Emitting Diode, LED, lighting device, said fixture comprising an LED driver arranged to receive an Alternating Current, AC, mains voltage as input and provide an LED current to drive said LED lighting device, and at least one socket comprising receiving means, arranged to receive and hold an LED lamp arranged to emit light. The socket further comprises a biased Double Pole Double Throw, DPDT, switch, comprising one set of input terminals and two sets of output terminals, wherein the output of said LED driver is connected to said input terminals of said biased DPDT switch, wherein a first of said two output terminals of said biased DPDT switch are short circuited.

The method comprises the steps of receiving, by said receiving means, said LED lighting device, and toggling, said biased DPDT switch from a short circuit position wherein said input terminals of said biased DPDT switch are connected to said first set of output terminals, to a connected position wherein said input terminals of said biased DPDT switch are connected to a second of said two output terminals, thereby connecting said LED driver to said LED lighting device.

It may be noted that the advantages and definitions associated with the first aspect of the present disclosure, being the lighting fixture, are also associated with the second aspect of the disclosure being the method of toggling a switch in the lighting fixture.

According to an embodiment of the second aspect of the present disclosure, the LED driver operates in a low power mode upon detecting a short circuit.

According to an embodiment of the second aspect of the present disclosure, the biased DPDT switch toggles from said connected position to said short circuit position when said LED lighting device is removed from said receiving means of said socket.

According to an example of the second aspect of the present disclosure, the receiving means is arranged to receive a dummy element, said dummy element being arranged to emulate an LED lighting device without emitting light.

These and other aspects of the invention will be apparent from and elucidated with reference to the embodiment(s) described hereinafter.

DETAILED DESCRIPTION

Figure 1:
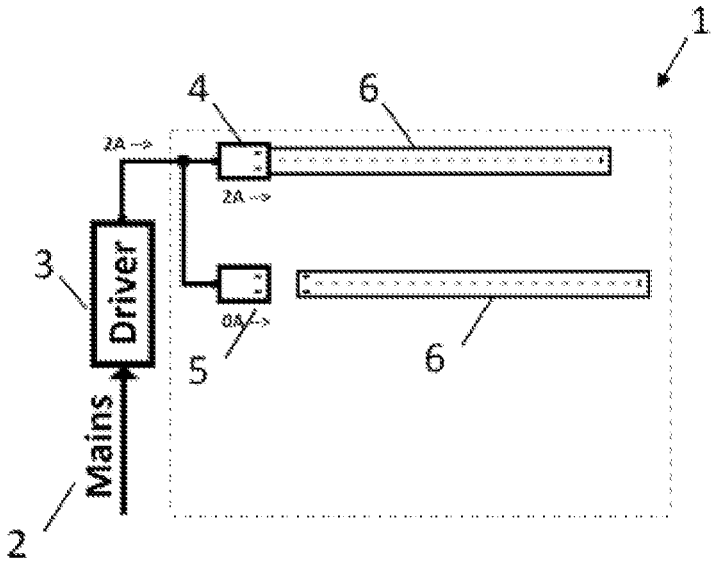
Fig. 1 Prior art
FIG. 1 illustrates a lighting fixture according to the prior art.

In all the figures, the same reference numeral indicates the same component or a similar component that performs the same or an essentially similar function.

FIG. 1 illustrates a lighting fixture 1 according to the prior art. The lighting fixture is suited to receive two LED lighting modules 6, in corresponding sockets 4, 5. In FIG. 1, an LED lighting module 6 has been inserted into the socket 4, whereas the other LED lighting module has not yet been inserted into the socket 5. The LED lighting modules receive electrical input power from a driver 3 which in turn receives input from an Alternating Current, AC, mains power supply 2.

LED driver 3, commonly has a rated output current, for example 2 Amperes. According to the prior art, if the LEDs are being replaced or inserted when the driver 3 is still powered on, in a situation as shown in FIG. 1, the connected socket will be subject to the full current, i.e. 2 Amperes, from the LED driver 3. This can cause damage to the connected LED module 6.

Figure 2:
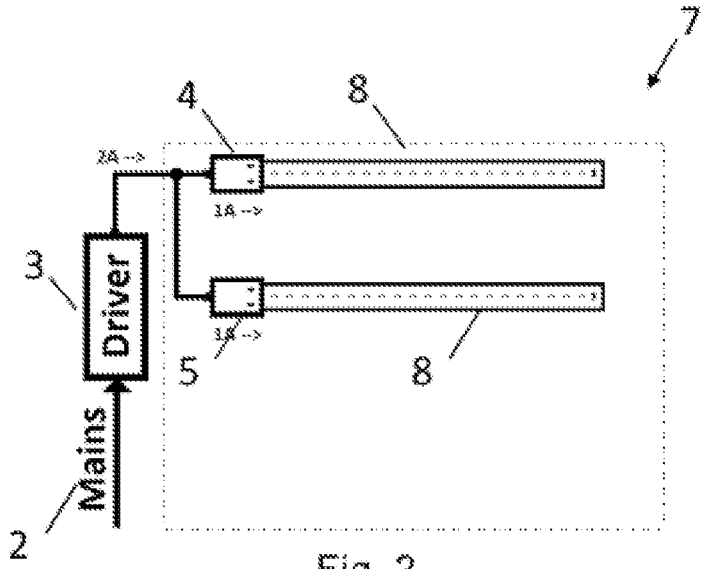
Fig. 2 Prior art
FIG. 2 illustrates a lighting fixture according to the prior art.

FIG. 2 illustrates a lighting fixture 7 according to the prior art. As shown by reference numeral 7, upon inserting two LED modules 8 in the sockets 4, 5, each of the LED modules 8 draws the same amount of current, i.e. 1 Ampere. It may be assumed that the illustrated LED modules 8 have a rated current of 1 Ampere each.

Figure 3:
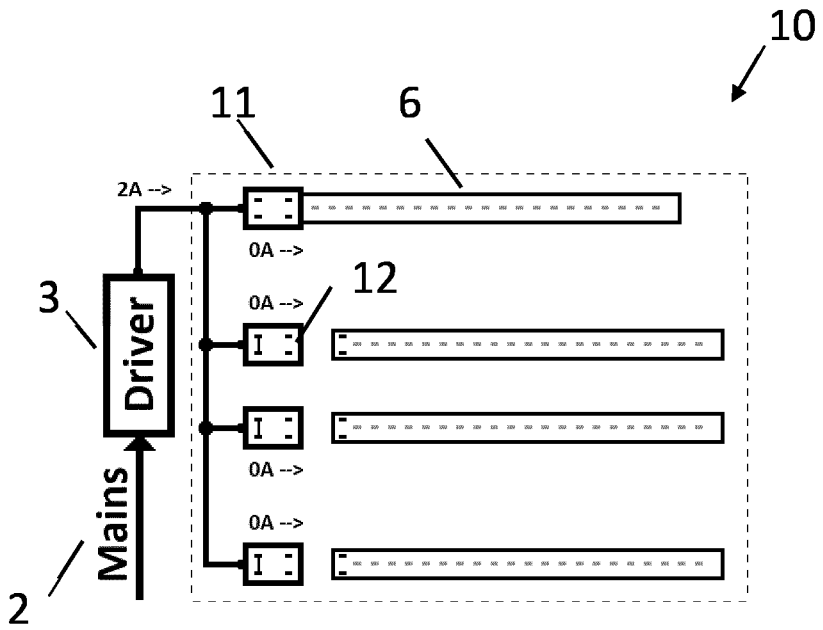
FIG. 3 illustrates an embodiment of a lighting fixture according to the present disclosure.

FIG. 3 illustrates an embodiment of a lighting fixture 10 according to the present disclosure. The embodiment in FIG. 3 is identical except for the sockets 11, 12, which are sockets according to the description of the present disclosure. Furthermore, the lighting fixture is arranged to support four LED lighting modules 6. According to the present example, the driver is arranged to provide a maximum current output of 2 Amperes, such that when operating, each LED lighting module 6 draws 0.5 Amperes each.

Each socket 11 comprises two sets of output terminals, and one set of input terminals (not shown in figure). The skilled person understands that a set of terminals comprises a positive terminal and a negative terminal that is arranged to be connected to corresponding terminals of another circuit. When the LED lighting module 6 is not inserted into a socket, as shown in 12, the socket is in a short circuit position such that the input terminals are connected to a short circuit.

Upon insertion of the LED lighting module 6, the lighting module 6 causes the toggling of an internal switch (not shown in figure), such that the input terminals are connected to the second set of terminals, thereby eliminating the short circuit. The LED driver 3, in an embodiment, is arranged to operate in a low power, hiccup, mode upon detecting a short circuit at its terminals. According to the present configuration, the LED driver 3 will see a short circuit at its output terminals unless and until an LED lighting module 6 is inserted in each one of the sockets.

The result is that the LED driver 3 does not provide any output current unless and until all the sockets receive an LED lighting module 6. This avoids the situation that any LED lighting module 6 will not be subject to a high inrush current, thereby the chances of a failure are reduced. If the number of LED lighting modules 6 required is less the number of available sockets, a dummy element may be inserted into the remaining empty sockets. A dummy element is arranged to emulate the physical, and preferably electrical, characteristics of an LED lighting module 6. Such a dummy element primarily serves the purpose of toggling the switch from a short circuit position to a connected position. Additionally, the dummy element may also draw a current equivalent to the current drawn by a light emitting LED lighting module.

Figure 4:
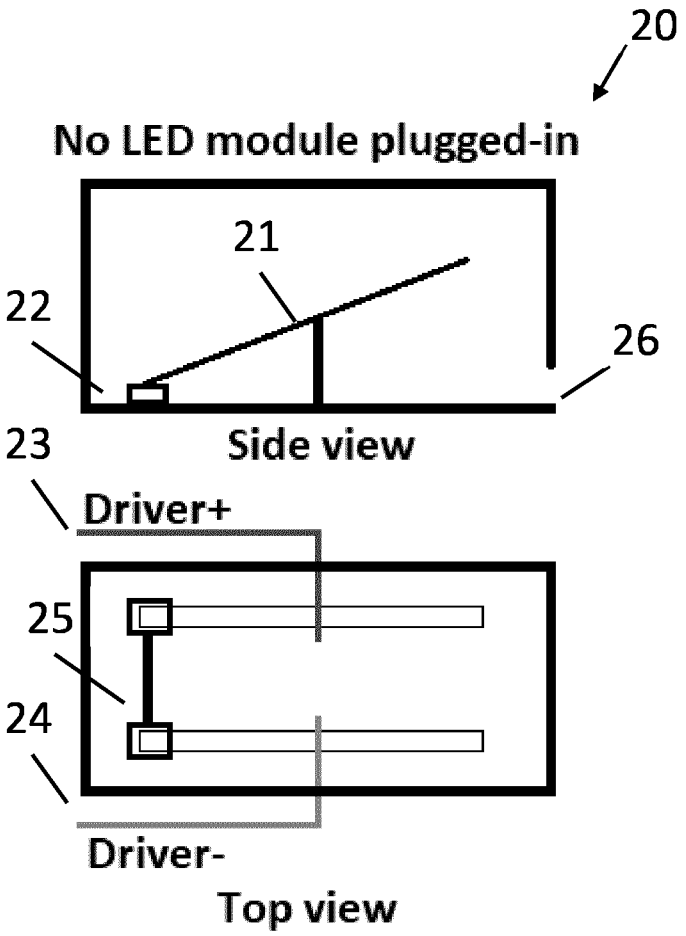
FIG. 4 illustrates an embodiment of a socket according to the present disclosure.

FIG. 4 illustrates an embodiment of a socket according to the present disclosure. The reference numeral 20 illustrates, in a side view and a top view, the socket according to the present disclosure. The socket comprises a receiving means arranged to receive and hold an LED lighting module. The receiving means may also comprise a latch or screw mechanism (not shown in figure) in order to hold the LED lighting module firmly in place.

When an LED lighting module is not inserted, the biased Double Pole Double Throw, DPDT switch 21 is in a short circuit position 22 such that the input terminals 23, 24 are connected to the first set of output terminals, that are internally short circuited 25. It may be understood by the skilled person that the receiving means may also be arranged to receive a dummy element as explained in the present disclosure.

Figure 5:
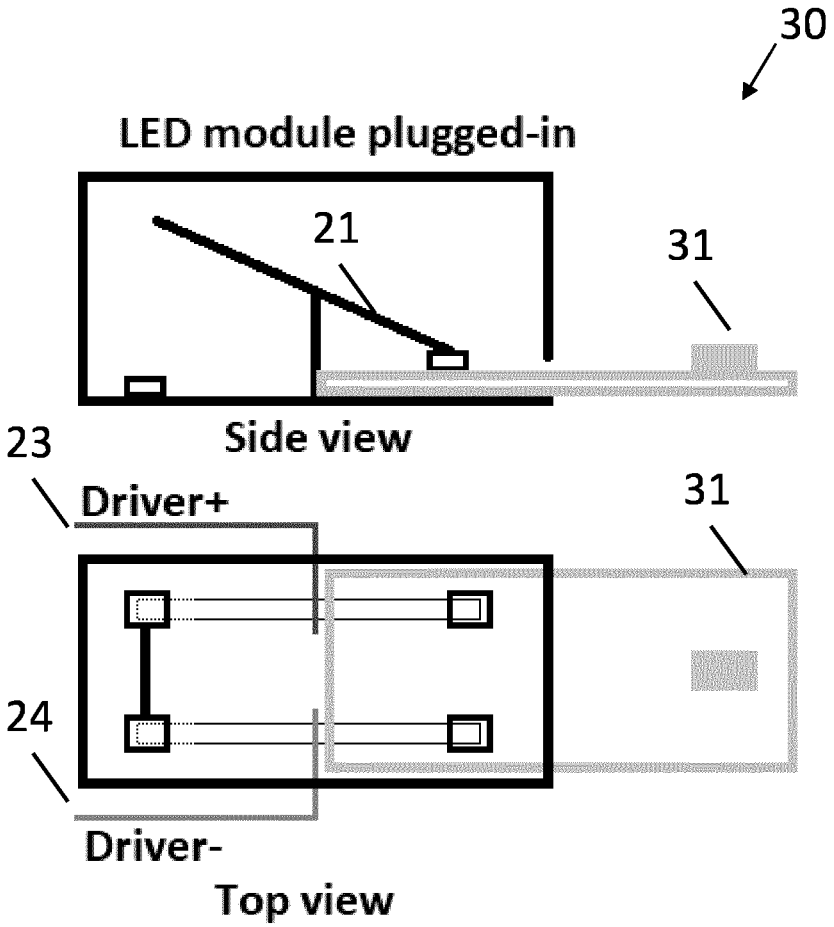
FIG. 5 illustrates an embodiment of a socket according to the present disclosure.

FIG. 5 illustrates an embodiment of a socket according to the present disclosure. Reference numeral 30 illustrates, in a side view and a top view, a socket according to the present disclosure, into which an LED lighting module 31 has been inserted. Upon insertion of the LED module 31, the biased DPDT switch 21 toggles into a connected position wherein the input terminals 23, 24 are connected to the second set of output terminals thereby connecting the LED driver to the LED lighting module 31.

An element of the present disclosure is to use the soft start function of an electronic Light Emitting Diode, LED, driver, by short circuiting the output of the driver inside a 'lever switch connector' when no LED module is plugged in. When all LED modules are plugged in, the short circuit in the lever switch connectors are switched off and the driver starts up. In this way, there is no outrush current from the driver through the LEDs.

Furthermore, it is not possible that a LED module receives too much current, the short circuit of the driver is only switched off when all the LED modules are plugged in.

When compared to the known methods of limiting the outrush current, no special electronic circuits are required to implement the solution according to the present disclosure and there is also no need for a slide or additional contacts on the LED module. This helps in keeping the cost of the LED module low and also simplifies the LED module.

According to the present disclosure, all socket must receive an LED module so that the LED driver does not see a short circuit at its output terminals. This may be problematic if, for example, only a fewer number of LED modules are required. In such a case, dummy modules may be inserted in to the socket such that it switches off the short circuit in the corresponding socket.

Such a dummy terminal may be a physical copy of the LED module without comprising any further electrical contacts or components. Inserting such a dummy module into the socket results in creating an open circuit at the particular terminals. This may result in a higher than usual current flowing through the connected LED modules. In order to address this issue, the dummy load may comprise an electrical load equivalent to that of an LED module without any light emitting elements.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article, "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope thereof.

The invention claimed is:

1. A lighting fixture for a Light Emitting Diode (LED); lighting device, said fixture comprising:

an LED driver arranged to receive an Alternating Current (AC) mains voltage as input and to provide an LED current to drive said LED lighting device;

at least one socket comprising receiving means, arranged to receive an LED lighting device arranged to emit light, said at least one socket further comprising a biased Double Pole Double Throw (DPDT) switch, comprising one set of input terminals and two sets of output terminals, wherein an output of said LED driver is connected to said input terminals of said biased DPDT switch, wherein a first of said two sets of output terminals of said biased DPDT switch are short circuited, and wherein said biased DPDT switch is arranged to toggle between:

a short circuit position wherein said input terminals of said biased DPDT switch are connected to said first set of output terminals, and a connected position wherein said input terminals of said biased DPDT switch are connected to a second of said two sets of output terminals, thereby connecting said LED driver to said LED lighting device;

wherein said biased DPDT switch is further arranged to toggle from said short circuit position to said connected position upon insertion of said LED lighting device into said receiving means of said socket.

2. The lighting fixture according to claim 1, wherein said LED driver is arranged to operate in a low power mode upon detecting a short circuit at its terminals.

3. The lighting fixture according to claim 1, wherein said biased DPDT switch is further arranged to toggle from said connected position to said short circuit position when said LED lighting device is removed from said receiving means of said socket.

4. The lighting fixture according to claim 1, wherein said biased DPDT switch is spring loaded.

5. The lighting fixture according to claim 1, wherein said receiving means is arranged to receive a dummy element, said dummy element being arranged to emulate an LED lighting device without emitting light.

6. The lighting fixture according to claim 5 comprising at least two sockets arranged to receive one LED lighting device per socket, such that said DPDT switch of at least one socket is in said short circuit position until each socket receives either said LED lighting device or said dummy element.

7. The lighting fixture according to claim 6, wherein said at least two sockets are connected in a parallel configuration such that said LED current from said LED driver is distributed between said at least two sockets.

8. A method of toggling a switch in a lighting fixture for a Light Emitting Diode (LED) lighting device, said fixture comprising an LED driver arranged to receive an Alternating Current, AC, mains voltage as input and provide an LED current to drive said LED lighting device, and at least one socket comprising receiving means, arranged to receive an LED lighting device arranged to emit light, said socket further comprising a biased Double Pole Double Throw (DPDT) switch, comprising one set of input terminals and two sets of output terminals, wherein an output of said LED driver is connected to said input terminals of said biased DPDT switch, wherein a first of said two output terminals of said biased DPDT switch are short circuited, said method comprising the steps of:

receiving, by said receiving means, said LED lighting device, and toggling, caused by said receiving of said LED lighting device, said biased DPDT switch- from a short circuit position wherein said input terminals of said biased DPDT switch are connected to said first set of output terminals, to a connected position wherein said input terminals of said biased DPDT switch are connected to a second of said two output terminals, thereby connecting said LED driver to said LED lighting device.

9. The method according to claim 8, wherein said LED driver operates in a low power mode upon detecting a short circuit at its terminals.

10. The method according to claim 8, wherein said biased DPDT switch toggles from said connected position to said short circuit position when said LED lighting device is removed from said receiving means of said socket.

11. The method according to claim 8, wherein said receiving means is arranged to receive a dummy element, said dummy element being arranged to emulate an LED lighting device without emitting light.

* * * * *